United States Patent [19]

Freber

[11] 4,226,398

[45] Oct. 7, 1980

[54] FURNITURE SWIVEL

[75] Inventor: Elmer C. Freber, St. Louis, Mo.

[73] Assignee: Marquette Tool and Die Company, St. Louis, Mo.

[21] Appl. No.: 3,107

[22] Filed: Jan. 15, 1979

[51] Int. Cl.[2] ..... F16M 13/00; A47C 1/02

[52] U.S. Cl. ..... 248/415; 108/139; 248/131; 248/425; 297/349

[58] Field of Search ..... 248/131, 425, 415, 349; 108/94, 103, 139, 141; 297/349; 312/252, 11; 308/25, 173, 139, 238

[56] References Cited

U.S. PATENT DOCUMENTS

| | | | |
|---|---|---|---|
| 2,529,780 | 11/1950 | Miller | 248/415 X |
| 2,710,644 | 6/1955 | Krueger | 108/139 |
| 3,283,358 | 11/1966 | Merriam | 248/349 |
| 3,593,954 | 7/1971 | Ritchie | 248/415 X |
| 4,098,485 | 7/1978 | Mizelle | 297/349 |
| 4,123,122 | 10/1978 | Gabrelson et al. | 308/238 |

*Primary Examiner*—James T. McCall

*Attorney, Agent, or Firm*—Gravely, Lieder & Woodruff

[57] ABSTRACT

A furniture swivel unit includes a base plate, a swivel plate positioned over the base plate, and a one-piece bearing located between the two plates. The base plate has an upwardly turned flange at its periphery, and the bearing, which may be molded from a low friction polymer, rests on the base plate along the flange. The swivel plate has a downwardly directed hub, the center of which is open to accommodate a retaining washer that is secured against the base plate and overlies a portion of the swivel plate, thus preventing separation of the two plates. The hub, moreover, projects into and seats against the bearing with the arrangement being such that the bearing takes both radial and thrust loading.

19 Claims, 6 Drawing Figures

FURNITURE SWIVEL

BACKGROUND OF THE INVENTION

This invention relates in general to furniture and more particularly to a swivel unit for furniture.

Some articles of furniture are equipped with swivel assemblies or units to enable the furniture, or at least a component of it, to be turned to various positions without physically lifting the furniture. For example, it is not uncommon to provide a so-called bar chair, particularly one having a back, with a swivel unit immediately below the seat of the chair so that the seat can be turned to afford easy access to it in the confined area around a bar. Similarly, boat seats are ofen equipped with swivels. Many television stands have a base and a swivel platform on which a television receiver rests so that the receiver can be turned to a wide variety of positions with little effort.

Perhaps the greatest use of swivel units for furniture occurs with bar chairs, and the conventional swivel unit for that use consists of nothing more than an upright tube that is anchored firmly on the furniture base and has a horizontal plate at its upper end, another plate located over the horizontal plate and having the seat attached to it, a single row of balls between the two plates, and a rivet joining the two plates together. To retain the balls in place, each of the two plates has an annular groove, and these grooves are located directly opposite to each other and concentric to the rivet. They receive the balls and thereby serve as raceways.

The typical swivel unit is sold to furniture manufacturers as a unit, and not as individual components, since no furniture manufacturer would want to undertake the tedious procedure of installing the bearing balls between the two plates of each unit, nor could this assembly operation be left for the ultimate consumer, even though such furniture is often sold in a knocked-down condition to facilitate storage and minimize transportation expenses. The furniture manufacturer usually applies paint to the swivel unit, and since the unit cannot be dismantled for painting, this paint often enters the space between the two plates and adheres to the raceways or balls, making the upper plate difficult to turn. Furthermore, because of the bearing, the unit should not be immersed in cleaning solvents, and this makes it difficult to prepare the unit for painting. For the same reason, the units cannot be plated, so such units are almost universally painted. Aside from that the two plates are rough steel stampings which have neither the precision nor the hardness normally associated with bearings. This coupled with the tight rivet connection often results in units that do not rotate with the ease that is desired. Finally, since the balls and the raceways are bare metal that is exposed to the atmosphere, they will in time rust, and this, of course, also makes the unit difficult to rotate.

SUMMARY OF THE INVENTION

One of the principal objects of the present invention is to provide a swivel unit which enables one component of furniture to swivel relative to another component. Another object is to provide a swivel unit of the type stated which is easily assembled and disassembled so that its two major components may be provided with different surface finishes. A further object is to provide a swivel unit of the type stated which may be assembled or dismantled with little difficulty by the ultimate user of the furniture. An additional object is to provide a swivel unit of the type stated which has covered bearing surfaces that are not easily oxidized. Still another object is to provide a swivel unit of the type stated which has a preadjusted bearing and swivels with relative ease in the preadjusted condition. Yet another object is to provide a furniture swivel that is simple and durable in construction and easy to manufacture. These and other objects and advantages will become apparent hereinafter.

The present invention is embodied in a swivel unit including a first member having a cross wall, a second member having a cross wall that overlies the cross wall of the first member and also an aperture in that cross wall, a bearing that is mounted on one of the members and has surfaces that conform to surfaces on the other of the members such that the bearing takes radial and thrust loading, and a retaining member that is attached to the first member through the aperture in the second member and overlies the second member to prevent the members from separating. The invention is also embodied in the combination of a pair of furniture components and the swivel unit located between the components. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
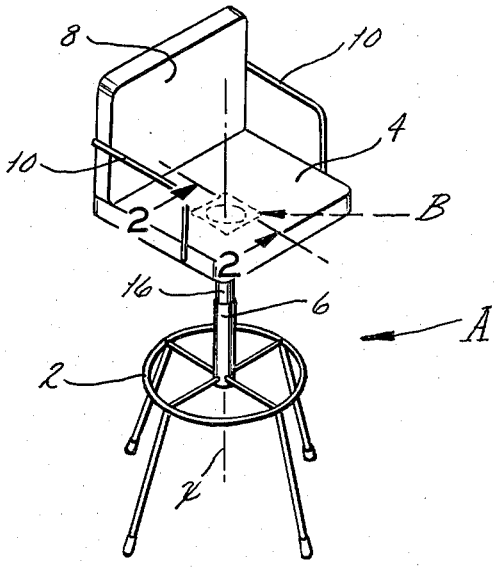
FIG. 1 is a perspective view of a chair provided with the swivel unit of the present invention.

Referring now to the drawings (FIG. 1), A designates a chair having a base 2 and a seat 4 which is supported on the base 2 by means of a swivel unit B that enables the seat 4 to turn relative to the base 2 about a vertical axis X. The base 2 has an upright tube 6 to which the swivel unit B is firmly attached. The swivel unit B is also firmly secured to the undersurface of the seat 4, which may be padded and upholstered on its upper surface. The seat 4 may also have a back rest 8 and arm rests 10 attached to it.

The swivel unit B includes a support tube 16 that fits within the upright tube 6 of the base 2 and may be adjusted to various elevations on the base 2. Welded to the upper end of the support tube 16 is a circular base plate 18 (FIGS. 2 and 3) which has a cross or bottom wall 20 that extends generally horizontally and is for the most part flat. At its center, the bottom wall 20 is perforated such that the displaced metal is turned downwardly and projects into the interior of the tube 16. The aperture that is so formed is threaded to provide the base plate 18 with a threaded central hole 22. At the periphery of the bottom wall 20, the base plate 18 is turned upwardly at an oblique angle in the form of a circular flange 22 that is concentric to the axis X of the hole 22. The flange 22 imparts a shallow cup-shaped configuration to the base plate 18. In addition to its threaded central hole 22, the base plate 18 is further provided with a pair of locator holes 26 which are located to the sides of the central hole 22 and 180° with respect to each other. The holes 26 are smaller in size than the threaded hole 22, yet lie close enough to the hole 22 to open into the interior of the support tube 16.

Inserted into the cup-shaped interior of the base plate 18 is an angular bearing 30 that fits snugly against and lines the inwardly presented surface of the circular flange 24 as well as the adjacent surface of the bottom wall 20. The bearing 30 has corresponding surfaces that serve as bearing surfaces, namely a tapered surface 32 that is presented inwardly toward the axis X and a horizontal surface 34 that is presented upwardly. The two bearing surfaces 32 and 34 are concentric to the axis X and merge at a fillet. The included angle between the surfaces 32 and 34 is greater than 90°, so that the surface 32 converges downwardly toward the bottom wall 20. Preferably, the bearing 30 is molded as a single unit from a durable polymer having a low coefficient of friction, such as nylon or various fluoropolymer resins, some of which are sold under the trademark TEFLON. The bearing 30 may also be machined from conventional bearing metals such as bronze or babbitt metal.

Figure 4:
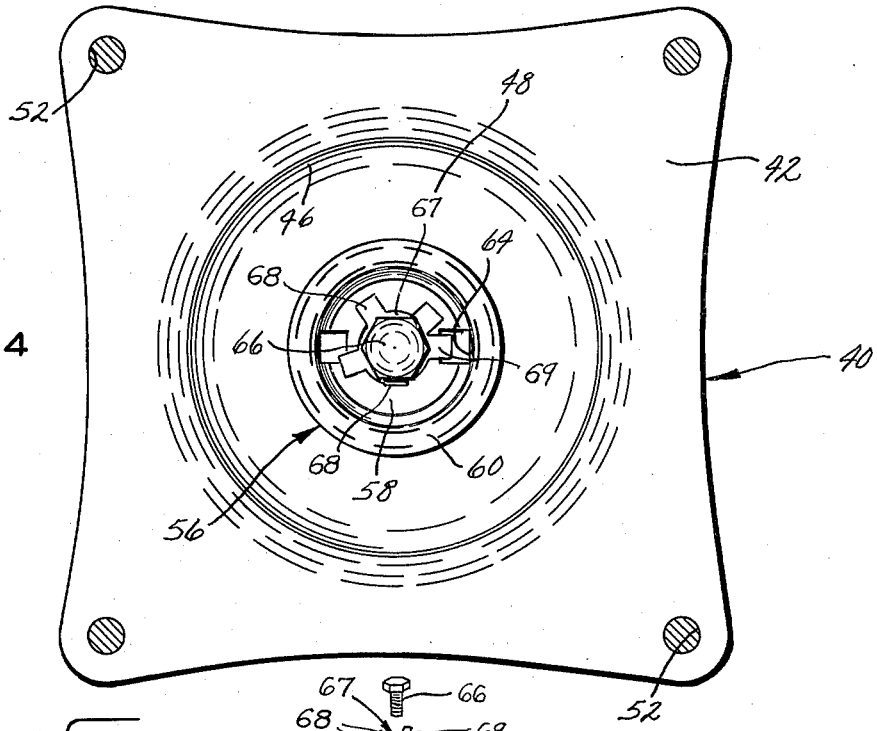
FIG. 4 is a top plan view of the swivel unit taken along lines 4—4 of FIG. 2.

The cup shaped base plate 18 and the annular bearing 30 within it support a swivel plate 40 (FIGS. 2 and 4) that is free to rotate on the bearing 30, but is otherwise confined on the base plate 18. The swivel plate 40 in turn is fastened to the underside of the seat 4, thus enabling the seat 4 to rotate on the base 2. Like the base plate 18, the swivel plate 40 is preferably a soft steel stamping. It includes a flat outside portion 42 that projects outwardly past the flange 22 on the base plate 18 and a hub 44 that is centered with respect to the outside portion 42 and fits into the bearing 30. The hub 44, in turn, has a tapered side wall 46 and a flat end or bottom wall 48. The former is concentric on the axis X and bears against the tapered surface 32 of the main bearing 30, while the latter is spaced, at least initially, from the horizontal surface 34 of the bearing 30, the clearance being about 0.005 to 0.010 inches. The arrangement is such that all thrust and radial loading is taken initially through the tapered surface 32 of the bearing 30 much in the same manner that a tapered roller bearing accommodates thrust and radial loading. The bearing 30, being formed from a low friction material, permits the swivel plate 40 to rotate easily on the base plate 18, even when subjected to heavy thrust loads. In time the surface 32 wears to the extent that bottom wall 48 of the hub 44 comes against the horizontal surface 34 of the bearing 30, in which case thrust loading is taken through both of the bearing surfaces 32 and 34. The corresponding tapers of the surface 32 and wall 46 facilitate assembly of the swivel unit B in that they provide a lead for guiding the hub 44 into the bearing 30. They also permit the swivel unit B to better accept variations in dimensional tolerances within the bearing 30 and hub 44.

Figure 2:
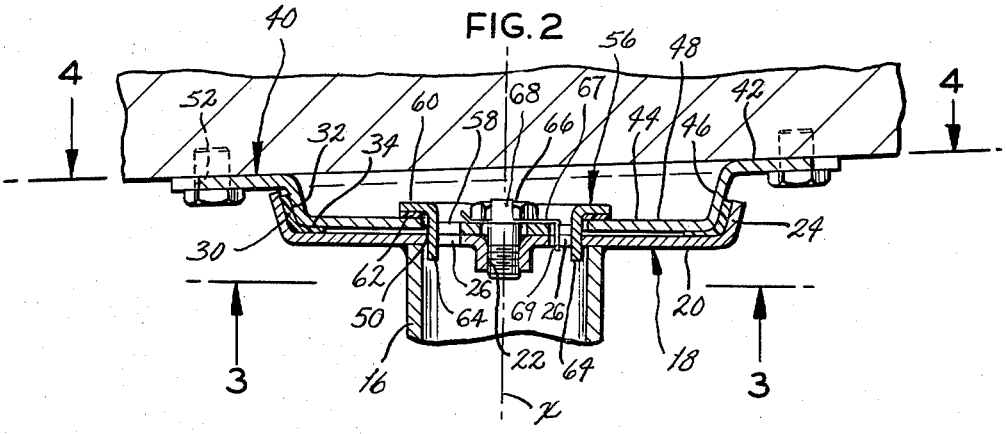
FIG. 2 is a sectional view of the swivel unit taken along lines 2—2 of FIG. 1.
Figure 3:
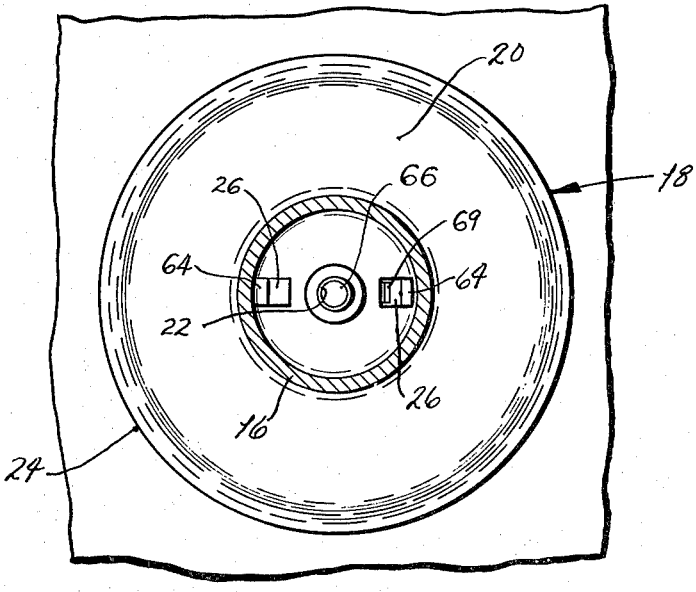
FIG. 3 is a bottom plane view of the swivel unit taken along lines 3—3 of FIG. 2.

The main bearing 30 spaces the bottom wall 48 of the hub 44 slightly upwardly from the bottom wall 20 of the base plate 18 (FIG. 2). The bottom wall 48 has a center aperture 50 that is concentric to the axis X and is slightly larger in diameter than the offset of the locator hole 24 in the wall 20, yet is considerably smaller in diameter than the bearing 30. Consequently, a major portion of the wall 48 is set inwardly from the bearing 30. While the bottom wall 48 is normal to the axis X, the plane of the flat outside portion 42 is slightly oblique to that axis, or, in other words, the flat outside portion 42 is inclined slightly with respect to the horizontal. The outside portion 42 fits against the underside of the seat 4 and is attached firmly to the seat 4, such as by wool or metal screws run through screw holes 52 at the corners of the outside portion 42.

The swivel plate 40 is retained on the base plate 18 by a retaining washer 56 having a central portion 58 that fits against the bottom wall 20 of the base plate 18 immediately outwardly from the threaded hole 20 therein and a peripheral lip 60 that is offset upwardly and overlies the bottom wall 48 immediately outwardly from the margin of the center aperture 50 in it. The lip 60 does not bear directly against the bottom wall 48 of the hub 44, but instead a thin flat bearing 62 (FIGS. 2 & 5) is interposed between the two, and this bearing, like the main bearing 30, is preferably molded from a low friction polymer, although other materials are acceptable. In fact, the flat bearing 62 may be omitted altogether, but the swivel unit B operates more smoothly with it. The axial offset of the peripheral lip 60 of the washer 56 is such that when the central portion 58 of the washer 56 is brought against the bottom wall 20 of the base plate 18, the flat bearing 62 and the main bearing 30 will be under a preload. To prevent the retaining washer 56 from rotating with the swivel plate 40, its central portion 58 has a pair of tabs 64 that are located 180° from each other and project downwardly into the locator holes 26 in the bottom wall 20 of the base plate 18. Each tab 64 is tapered slightly so that its side edges engage the sides of its locator hole 24 and preclude all rotational movement at the tab 64. The retaining washer 56 is also preferably a soft steel stamping, with the tabs 64 being derived by lancing.

Figure 5:
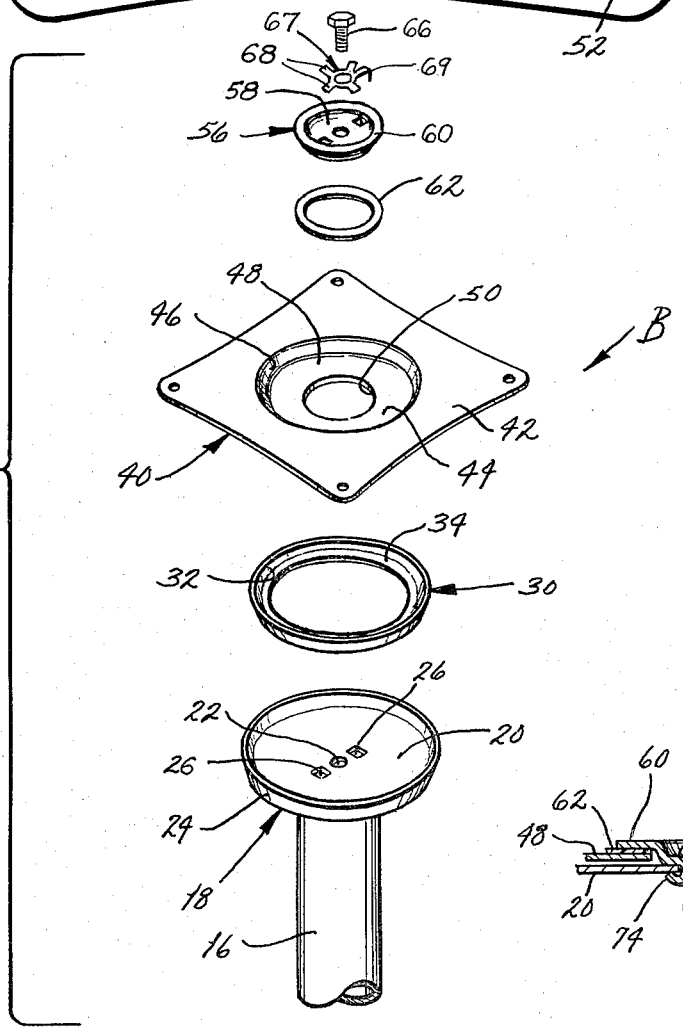
FIG. 5 is an exploded perspective view of the swivel unit.

The retaining washer 56, the flat bearing 62, the swivel plate 40, the bearing 30, and the base plate 18 are all held together in that order by a machine bolt 66 which passes through the central portion 58 of the retaining washer 56 and threads into the central hole 22 of the base plate 18. The bolt 66 is run down sufficiently to clamp the central portion 58 of the washer 56 tightly against the bottom wall 20 of the base plate 18. This places both bearings 30 and 62 under preload. While the tabs 64 secure the washer 56 against the rotation on the base plate 18, the possibility of the bolt 66 working loose through ratchetting is completely eliminated by a star washer 67 located beneath the head of the bolt 66. This washer has four of tabs 68 radiating from its main body, and these tabs 68 are turned up slightly and are spaced at equal angles, with that angular spacing being somewhat greater than the angular spacing between the flats on the head of the bolt 66. In addition, the star washer 67 has a somewhat longer tab 69 which projects outwardly toward one of the tabs 64 on the retaining washer 56, and at its end is turned downwardly into the aperture left in the washer 56 as a result of the tab 64 being lanced from the washer 56. The downwardly turned portion of the tab 69 is long enough to project into the underlying locator hole 26 in the bottom wall 20 of the base plate 18. This completely immobilizes the star washer 67. Once the bolt 66 is tightened to the desired extent, that tab 67 which best aligns with one of the flats on the head of the bolt 66 is brought up against that flat, and this prevents the bolt 66 from turning. Thus, the bolt 66 does not experience any tendency to work loose as the swivel plate 40 rotates relative to the base plate 18, yet it enables the swivel unit B to be easily dismantled (FIG. 5).

The swivel unit B may be sold to furniture manufacturers in an assembled or disassembled condition. If the furniture manufacturer desires to apply different surface coatings to the base plate 18 and swivel plate 40, then of course it would be desirable to apply those coatings while the unit B is disassembled. In any event, the unit B is easily assembled by merely inserting the main bearing 30 into the cup-shaped base plate 18, and then inserting the hub 44 of the swivel plate 40 into the main bearing 30. Next, the retaining washer 56 with the flat bearing 62 around it is inserted into the center aperture 50 in the swivel plate 40, care being exercised to insure that the tab 64 aligns with the locator hole 26 in the base plate 18. Then the star washer 67 is installed with its tab 69 projecting through the underlying retaining washer 56 and into the locator hole 26 of the base plate 18. Finally, the machine bolt 66 is threaded into the hole 20 of the base plate 18 and turned down sufficiently to clamp the central portion 58 of the retaining washer 56 firmly against the bottom wall 20 of the base plate 18. This preloads the bearings 30 and 62. Finally, one of the tabs 68 on the star washer 67 is turned up against a flat on the head of the bolt 66 to secure the bolt 66.

When the swivel unit B is completely assembled, the swivel plate 40 rotates with relative ease on the main bearing 30 that is in turn supported on the base plate 18. The tapered wall 46 on the hub 44 of the swivel plate 40 seats against the tapered surface 32 of the main bearing 30, but the bottom wall 48 is initially spaced a slight distance from the horizontal surface 34 of the bearing 30. Thus, initially all of the thrust and radial loading is taken through the tapered surface 32. As that surface wears, the flat bottom wall 48 on the hub 44 moves toward and eventually contacts the horizontal surface 34 of the bearing 30, at which time the thrust loading is taken through both the tapered surface 32 and the horizontal surface 34. In other words, the surfaces 32 and 34 wear into a perfect fit with the walls 46 and 48, respectively, of the hub 44. The bearing 30, being formed from a relatively soft material, conforms to any imperfections in the abutting walls 46 and 48 on the hub 44 so that the rotational movement is quite smooth and not interrupted by any tendency to bind at various degrees of rotation as is typical of current ball bearing units. Since the bearings 30 and 62 are, in effect, preadjusted, no particular skill is required in assembling the swivel unit B, and indeed the final assembly may be left to the furniture manufacturer or even to the ultimate purchaser.

The swivel unit B may be used on a wide variety of furniture including chairs and television stands.

Figure 6:
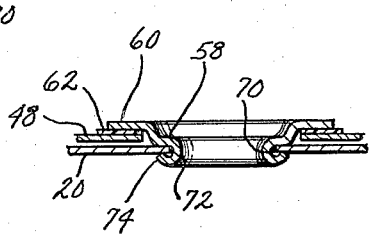
FIG. 6 is a fragmentary sectional view of a modified swivel unit that is unitized.

The bolt 66 permits the swivel unit B to be disassembled into its various components. However, the swivel unit B may be unitized on a permanent basis by substituting a rivet for the bolt 66. A unitized swivel unit B may also be obtained by providing an enlarged hole 70 (FIG. 6) in the bottom wall 20 of the base plate 18 in lieu of the threaded hole 22 and deforming or curling the central portion 58 of the retaining washer 56 through the hole 22 in the form of a collar 72. Thereafter the collar 72 is turned outwardly to provide a retaining lip 74 that underlies the bottom wall 20 of the base plate 18.

This invention is intended to cover all changes and modifications of the example of the invention herein chosen for purposes of the disclosure which do not constitute departures from the spirit and scope of the invention.

What is claimed is:

1. In combination with a piece of furniture having two components that swivel relative to each other about an axis, an improved swivel unit between the components, said swivel unit comprising a first plate attached to one of the furniture components and having a cross wall and a generally axially directed flange at the periphery of the cross wall with the flange being concentric to the axis; a bearing set into the first plate such that it lines the inwardly presented surface of the flange and the adjoining surface of the cross wall; a second plate overlying the first plate and being attached to the other furniture component, the second plate having a hub that projects toward the first plate and bears against the bearing such that the bearing takes both axial and radial loading; and retaining means for preventing separation of the first and second plates.

2. The structure according to claim 1 wherein the hub on the second plate has a cross wall that overlies the cross wall on the first plate and the retaining means comprises a washer having a center portion that is against the cross wall of the first plate and a peripheral portion that overlies the cross wall on the second plate so that the cross wall of the second plate is captured between the peripheral portion of the washer and the cross wall of the first plate, and means for clamping the center portion of the washer firmly against the cross wall of the first plate.

3. The structure according to claim 2 wherein the cross wall of the first plate has a threaded hole located along the axis of rotation and the means for clamping the center portion of the washer is a bolt that threads into the aperture in the cross wall of the first plate and is turned down tightly against the washer.

4. The structure according to claim 3 and further comprising means for preventing the washer from rotating with respect to the first plate.

5. The structure according to claim 3 wherein the first plate has a locator hole offset from its threaded hole and the washer has a tab projected from its center portion into the locator hole to prevent the washer from rotating with respect to the first plate when the second plate turns relative to the first plate.

6. The structure according to claim 4 and further comprising another bearing between the peripheral portion of the washer and the underlying cross wall on the hub of the second plate.

7. The structure according to claim 6 wherein the peripheral portion of the washer is offset axially from the central portion a distance which preadjusts the bearings.

8. The structure according to claim 3 and further comprising an upright support tube attached to the cross wall of the first plate around the threaded hole therein and extending away from the first plate.

9. A swivel unit for enabling one component of furniture to rotate with respect to another component of furniture about an axis of rotation, said swivel unit comprising a first member capable of being attached to the one component and including a cross wall and a generally axially directed flange extended from the cross wall; a first bearing formed from a low friction material and being against both the cross wall and the flange of the first member, the first bearing having a tapered bearing surface that is positioned at an oblique angle with respect to the axis of rotation and another surface that is generally perpendicular to the axis of rotation; a second member capable of being attached to the other component of furniture and being formed from a substance that is more resistant to wear than the bearing, the second member including a hub provided with a tapered side wall and an end wall, the tapered side wall bearing against and conforming to the tapered surface of the bearing while the end wall is initially spaced from the other surface of the bearing, so that as the bearing wears along its tapered surface, the end wall of the hub will eventually contact and be supported to limited measure by the other surface of the bearing; and retaining means for preventing separation of the first and second members.

10. A swivel unit according to claim 9 wherein the retaining means comprises a retaining member that is attached to the first member and overlies the end wall of the second member.

11. A swivel unit for enabling one component of furniture to rotate relative to another component of furniture about an axis of rotation, said swivel unit comprising: a first member capable of being attached to the one component of furniture and including a cross wall that is generally perpendicular to the axis of rotation and a generally axially directed flange extended from the cross wall, the flange being tapered; a second member capable of being attached to the other component of furniture and including a hub that fits into the first member and includes an end wall that lies opposite to the cross wall of the first member and a tapered wall that extends from the end wall and is located opposite to the tapered flange of the first member, the end wall having a centrally disposed circular aperture beyond which the cross wall of the first member is located; a bearing interposed between the tapered walls of the first and second members and also between the cross wall of the first member and the end wall of the second member, the bearing being formed from a material that is softer and less resistant to wear than the materials from which the first and second members are formed; and a retaining member including a central portion and an axially offset portion that projects radially from central portion, the central portion projecting through the aperture in the end wall of the second member and being clamped firmly against the cross wall of the first member such that it will not rotate with respect to the first member, the axially offset portion being projected over the end wall of the second member so as to permit the first and second members to rotate relative to each other, yet to prevent the first and second members from separating.

12. A swivel unit according to claim 11 wherein the retaining member has a tab projected from its central portion into the first member to prevent the retaining member from rotating on the first member.

13. A swivel unit according to claim 11 and further comprising another bearing between the axially offset portion of the retaining member and the end wall of the second member.

14. A swivel unit according to claim 10 and further comprising means for preventing the retaining member from rotating with respect to the first member.

15. A swivel unit according to claim 10 and further comprising a second bearing between the retaining member and the cross wall of the second member with the second bearing being oriented to take thrust loading in one axial direction and the first bearing being oriented to take thrust loading in the other axial direction.

16. A swivel unit according to claim 15 wherein the first bearing is formed from a material that is softer than the first or second members.

17. A swivel unit according to claim 14 wherein the retaining means further comprises a bolt that extends through the retaining member and threads into the first member so as to clamp the retaining member and first member tightly together.

18. A swivel unit according to claim 14 wherein the retaining member has a center portion that is clamped tightly against the cross wall of the first member and an axially offset lip that overlies the cross wall on the second member.

19. A swivel unit according to claim 9 wherein the second member further has an outside portion that projects outwardly from the hub for attachment to the component of furniture.

* * * * *